US011608968B2

(12) United States Patent
Ruggiero

(10) Patent No.: US 11,608,968 B2
(45) Date of Patent: Mar. 21, 2023

(54) LIGHT EMITTING DIODE RADIANT BEAM PANEL

(71) Applicant: Michael Victor Ruggiero, Bronx, NY (US)

(72) Inventor: Michael Victor Ruggiero, Bronx, NY (US)

( * ) Notice: Subject to any disclaimer, the term of this patent is extended or adjusted under 35 U.S.C. 154(b) by 60 days.

(21) Appl. No.: 17/731,323

(22) Filed: Apr. 28, 2022

(65) Prior Publication Data

US 2022/0349557 A1 Nov. 3, 2022

Related U.S. Application Data

(60) Provisional application No. 63/182,351, filed on Apr. 30, 2021.

(51) Int. Cl.
*F21V 21/005* (2006.01)
*F21V 3/00* (2015.01)
*F21Y 105/16* (2016.01)
*F21Y 115/10* (2016.01)

(52) U.S. Cl.
CPC ..... *F21V 21/005* (2013.01); *F21V 3/00* (2013.01); *F21Y 2105/16* (2016.08); *F21Y 2115/10* (2016.08)

(58) Field of Classification Search
CPC ..... F21V 3/00–0625; F21V 21/00–30; F21V 2200/20; F21Y 2105/16; F21Y 2115/10
See application file for complete search history.

(56) References Cited

U.S. PATENT DOCUMENTS

2015/0219830 A1* 8/2015 Nohara ..... E06B 9/24 362/147

* cited by examiner

*Primary Examiner* — Jason M Han

(57) ABSTRACT

Embodiments of the present disclosure relate to the fields of architectural lighting, backlit displays of fine art, graphic art and photographs, and architectural partitioning by using a Beam Penal which provides both direct lighting and diffused lighting, using a linear array of LEDs as light sources.

20 Claims, 14 Drawing Sheets

(a)

(b)

LIGHT EMITTING DIODE RADIANT BEAM PANEL

TECHNICAL FIELD

The present disclosure relates to the fields of Architectural Lighting, Backlit Displays of Fine Art, Graphic Art and Photographs, and Architectural Partitioning.

BACKGROUND

Architectural lighting design is a field of work or study that is concerned with the design of lighting systems within the built environment, both interior and exterior. The objective of architectural lighting design is to balance the art and the science of lighting to create mood, visual interest and enhance the experience of a space or place while still meeting technical and safety requirements.

In recent years, because of rapid commercialization of Light-Emitting Diodes (LEDs), low cost LEDs are used for task, accent, ambient, and decorative lighting. LEDs are characterized by high energy efficiency, high reliability, low voltage, low heat generation, and availability in multiple colors. They can be dimmed, and programmed for rapid transitions between on and off states.

Task lighting by LEDs is often bright white and most useful for getting work tasks done expeditiously. Some examples of task light typically incorporates reflective surface to direct focused light through opening of the fixtures as shown in FIG. 1. Single LED or multiple LEDs can be used in one light fixture. In contrast to task lighting, ambient lighting is vital for general illumination, relaxation, and socialization. Colored light has been proven to have therapeutic values both psychologically and physically.

LED backlit panels are increasingly used in the display of wall fine art, photographs and graphic art, most notably for commercial signage. In these LED Backlit panels, only their front translucent sheet are illuminated, which provides ambient light to varying degrees. Some examples of this kind of lighting are shown in FIG. 2. The translucent material are fabrics such as canvas and wide range of synthetic materials. Acrylic sheets are examples of synthetic material and widely used.

LED backlit panels can be found free-standing in space, hung or attached to a wall, and suspended from a ceiling. Free standing can be from floor with attached support stand, or elevated on a pedestal or a table of varying dimensions. This Free standing on a table is hereafter called "tabletop" or "desktop" placement.

When scaled up in dimensions and electrical power, LED backlit panels are suitable for lighting events, stage setting for theater and concerts, tradeshows and conventions. The applications of LED backlit panels as described above are limited to specific purposes such as ambient lighting or task lighting. They either employ diffused light for ambient lighting or focused light for task lighting. Further, there is no specific light design for architectural partitioning which separates rooms or functions, creates privacy, and scales down rooms horizontally and/or vertically. Conventional lamps with shades, as depicted in FIG. 3, produce both diffused light and directional light and can be used for both ambient lighting and task lighting. But, they cannot be used for architectural partitioning with any flexibility. Thus, it is desirable to have an integrated solution to combine ambient lighting with unique function for flexible tabletop and architectural partitioning.

Combining architectural definition, accentuation of existing structural members and objects in a given space, Beam Panel described hereafter reduces efforts to install decorative light fixture and lights in subdivided spaces or localized spot in a room separately. Moreover, free-standing Beam Panels can be moved readily to achieve same colored lighting effect in any room with any electrical outlet desired. Beam Panels can be installed in modules side-by-side or separately as needed.

BRIEF SUMMARY

The present disclosure describes a Light Emitting Diode Radiant Beam Panel emitting both diffused light for ambient or accent lighting purposes and directional light for an architectural partitioning purpose. To produce architectural partitioning feature such as straight-line patterns on illuminated surfaces without complicated optics, LEDs as light sources in a linear arrangement are mounted side way respect to a diffusing panel. An aperture along the sides of diffusing panels allow direct lighting from the LEDs to escape the Beam Panel. The diffused lighting coming out from diffusing panels provides ambient lighting. Beam Panel can be mounted or attached to a wall or ceiling. Further, Beam Panel can be freestanding on table and desks or mounted on stands for partitioning the rooms In one example, a Radiant Beam Panel comprise a structural frame, a plurality of light-emitting diodes (LEDs), a translucent panel and a semi-opaque panel. The translucent panel is mounted to one side of the frame and the semi-opaque panel is mounted to an opposite side with an aperture. The LEDs is mounted on the inside surface of the fame. The light coming out from the Radiant Beam Panel from the translucent panel and the semi-opaque panel is characterized as diffused lightings with a broad emission angle. The light coming from the Radiant Bean Panel from the aperture is characterized as direct lighting with a much narrower emission angle. The light coming out from the semi-opaque panel is dimmer than that from the translucent pane, In one example, a Radiant Beam Panel comprise a structural frame, a plurality of light-emitting diodes (LEDs), a translucent panel and a semi-opaque panel. The semi-opaque panel is mounted to one side of the frame and the translucent panel is mounted to an opposite side with an aperture. The LEDs is mounted on the inside surface of the fame. The light coming out from the Radiant Beam Panel from the translucent panel and the semi-opaque panel is characterized as diffused lightings with a broad emission angle. The light coming from the Radiant Bean Panel from the aperture is characterized as direct lighting with a much narrower emission angle. The light coming out from the semi-opaque panel is dimmer than that from the translucent pane, In another example, the Radiant Beam Panel further comprise a plurality of light sensors and a control electronics. The light outputs of and timing of LEDs can be controlled based on the feedback of the light sensors.

In another example, the Radiant Beam Panel further comprise a mounting assembly which can attach the Radiant Beam Panel to a ceiling, a wall or allow the Radiant Beam Panel freestanding on a table or a floor.

These and other aspects of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and examples, should be viewed as combinable unless the context of the disclosure clearly dictates otherwise.

It will therefore be appreciated that this Summary is provided merely for purposes of summarizing some examples so as to provide a basic understanding of some aspects of the disclosure without limiting or narrowing the scope or spirit of the disclosure in any way. Other examples, aspects, and advantages will become apparent from the following detailed description taken in conjunction with the accompanying figures which illustrate the principles of the described examples.

BRIEF DESCRIPTION OF THE DRAWINGS

For a more complete understanding of various examples, reference is now made to the following detailed description taken in connection with the accompanying drawings in which like identifiers correspond to like elements.

DETAILED DESCRIPTION

Figure 1:
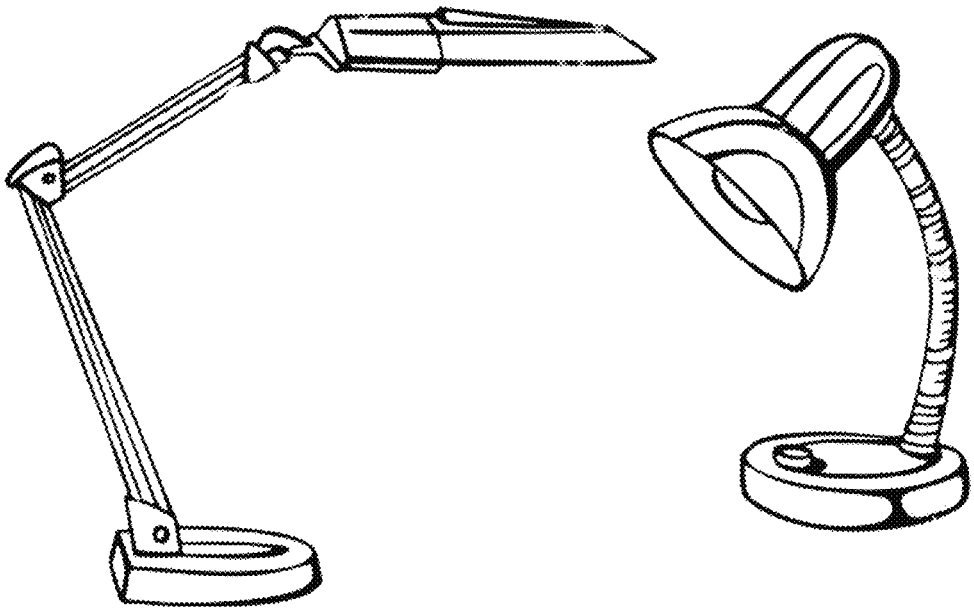
FIG. 1 (Prior Art)
FIG. 1 shows prior art examples of directional lighting.

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures. Without limiting the scope of the present invention, embodiments of the disclosure provide examples implemented.

Lighting is a very broad field which encompasses, but not limited to, Canvas print display, backlighting of TV & desktop monitors, signage, interior LED wall panel, interior light fixture, architectural partition/room divider, residential & corporate office, art gallery exhibition LED panel, concert, theater set, tradeshows, conventions, etc. With commercialization of Light Emitting Diodes (LEDs), there are increasingly new ways to use light. Several unique properties of LEDs help to break the constraints of traditional light fixture designs. First, LEDs come with small form factors to allow flexible assembly. The size of LED chips are in the order of 1 to 4 $mm^2$, so small that they can be hidden easily. Second, regardless its power outputs, LED's light can produce certain spectra by design. Traditional incandescence light sources (light bulb) emit different white spectra characterized by so-called "color temperatures". By physics, higher power light bulbs emitting more blue-light portion of white light, thus appearing "cooler". To change its color temperature, additional filters might be needed. A light fixture with light sources having different color temperatures often produce undesirable effects. The color temperature control with multiple light bulbs with different power output presents challenges to the designers of artistic lighting. On the other hand, the color temperature of the emitting spectra of LEDs do not change much over the operating temperature range, thus allowing mixing LEDS without concerns of color purity and consistency. Having controllable emission spectra, a large quantity of LEDs can be assembled into array forms, such as linear arrays. Therefore, LED light sources in forms of LED stripes have become common products at very low costs. Third, with arrays of LEDs as light sources, the combined emission illumination can be used to create effects which are not easily available from single point source of incandescent light sources. LEDs come with different emission angles determined by their package designs. Some LEDs have narrow emission angles and some have broad emission angles. The combination of these LEDs, special illumination distribution can be created according to the designers' intents. Fourth, with arrays of LEDs, the heat generated by far-more-energy-efficient LEDs is distributed across large area, unlike incandescence light sources, so that cooling of the light fixtures are of much less concerns. The relaxation of cooling consideration enables the designers to design new creative effects with new form factors. Further, LEDs come with many different colors and can be programmed to be turned on at different timing, thus creating artistic effects not economically available in the traditional lighting.

Given the advancements of LEDs, the light fixtures can be designed, taking the above mentioned advantages. However, the use modes of light fixtures only evolves slowly because the behavioral changes of human are slow. People don't demand new lighting effects until they see what designers can create for them. For these reasons, the revolution by LEDs primarily is driven by their energy efficiency. Consequently, LED products are mostly designed and sold for replacements such as LED light bulbs and LED light tubes.

Figure 2:
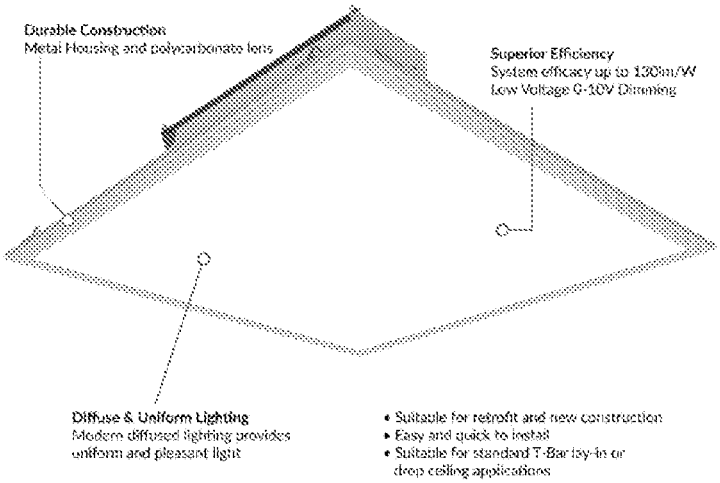
FIG. 2 (Prior Art)
FIG. 2 shows prior art examples of diffused lighting
Figure 2:
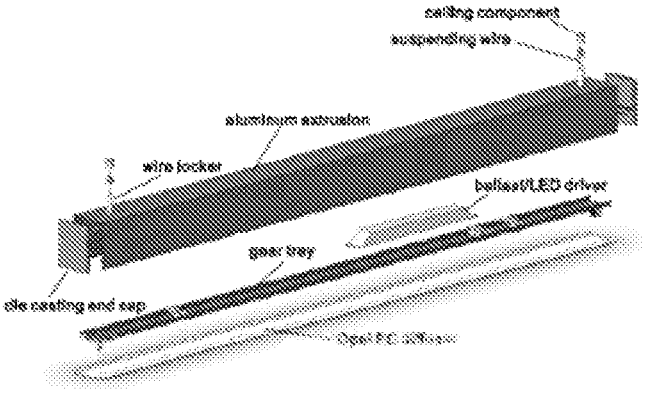
FIG. 2 (Prior Art)
Figure 3:
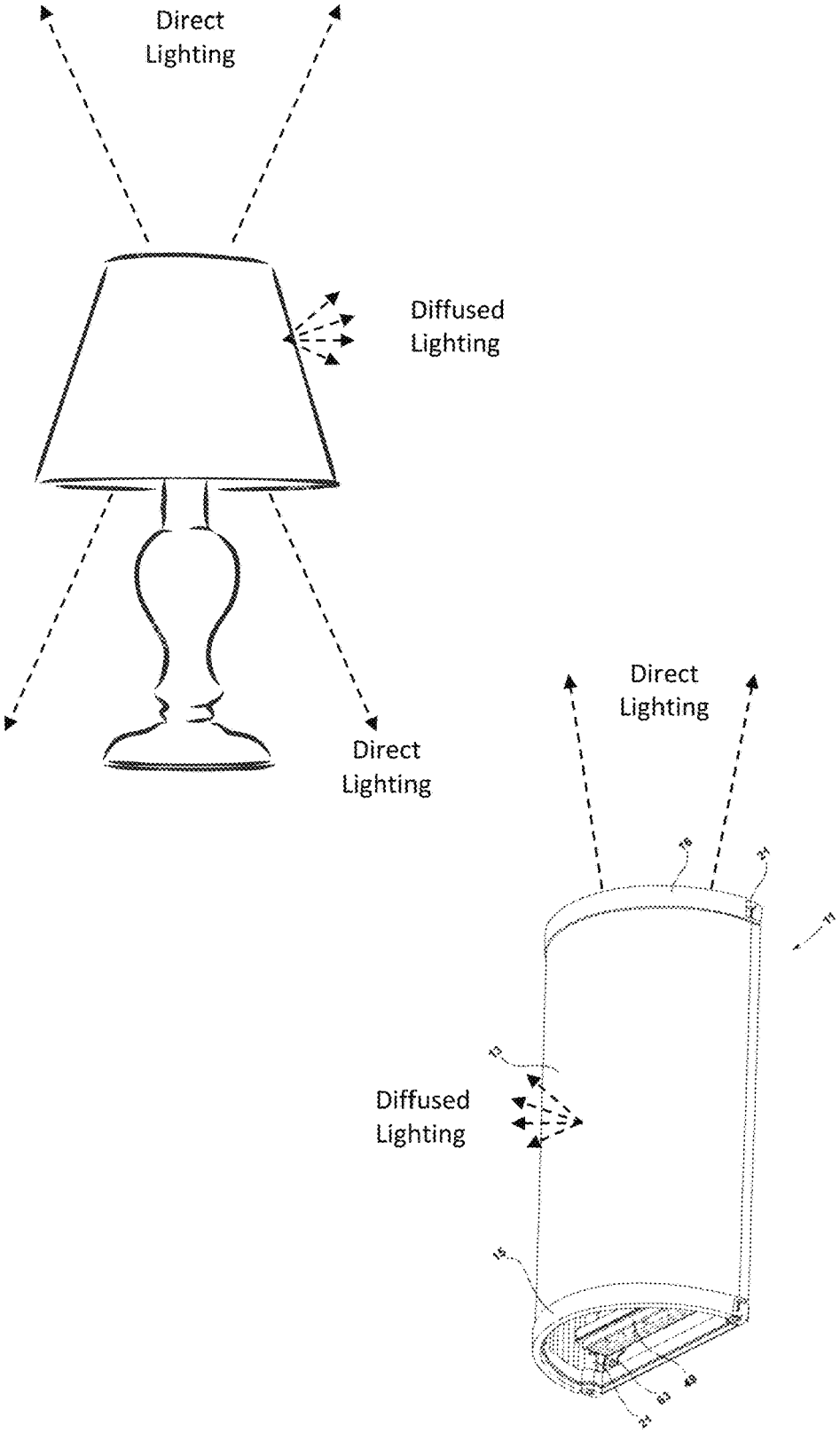
FIG. 3 (Prior Art)
FIG. 3 shows prior art examples having both directional lighting and diffused lighting.

The present invention is related to use array of LEDs in a fixture design to create unique light effects which were previous not practical nor economical. As discussed above, there are numerous applications by light fixture. But, lighting mechanisms can be broadly categorized into two: diffused lighting and direct lighting. FIG. 1 illustrates the first category of direct lighting mechanism. With direct lighting, the illumination of the intended targets are shined by the rays emitted by the LEDs directly or reflected by curved reflectors. This type of applications generally demand high brightness in certain areas and is often called task lighting. FIG. 2 illustrate the second category of diffused lighting mechanism. With diffused lighting, the light emitting by LEDs first impinge upon a diffuser which scatters the light into much broad angle ranges. This type of applications generally demand uniform brightness in a large area and is often called ambient lighting. When their artistic effects, rather than brightness, are more an important consideration, they are often called decorative lighting. In general, the light fixtures either employ direct lighting mechanism or diffused lighting mechanism. However, there are examples employing a combination of both direct and diffused lightings as shown in FIG. 3. In the case of a lamp, the light source is at the center of the lamp. The diffused light are used for ambient lighting and the downward direct light, if needed, are used for task lighting (i.e. reading). For the case of a sconce, the primary purpose is still for ambient lighting. The openings for directing, just like a lamp, are for hot air to escape the light fixtures to cool down the light bulbs.

When using LEDs and LED arrays in a light fixture, the cooling consideration is much relaxed so that the mount positions of the LEDs can be very flexible. This flexibility is utilized in the present invention for creating direct lighting for architectural partitioning purposes. This intended architectural effects will become apparent in latter descriptions hereafter.

Figure 4A:
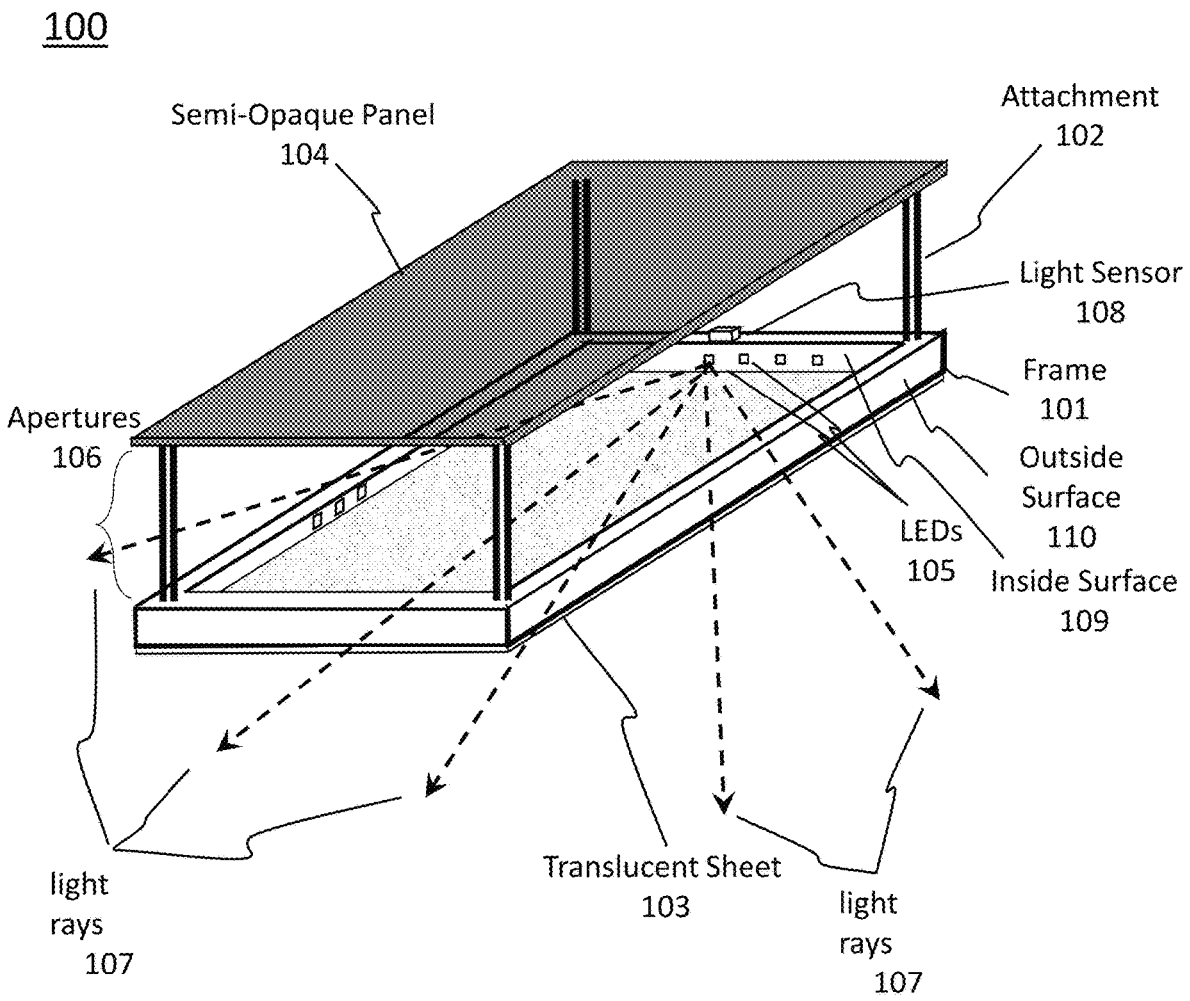
FIG. 4A-B depict a Beam Panel according to some embodiments of the present disclosure.

FIG. 4A depicts one embodiment in accordance of the present invention. The Beam Panel 100 comprises of frame 101, attachments 102, translucent sheet 103, semi-opaque panel 104, and a plurality of LEDs 105. LEDs 105 are mounted along inside surfaces 109 of the frame 101 which also provides heat extraction from LEDs 105. LEDs 105 may be mounted on one or more than one side of inside surfaces 109 of frame 101. As depicted in FIG. 4A, inside surfaces 109 face toward apertures 106 and the light rays of an LED mounted on one side can exit Beam Panel through apertures 106 of other sides. The distances between LEDs 105 can be uniform or not uniform according to desired effects. Although LEDs 105 are shown to be mounted along a straight line, they can be mounted not along a straight line. For the purpose of clarity, only a few LEDs 105 are shown in the inside surface of the frame for the purpose of clarity. LEDs 105 can be mounted facing one, two or all directions. A person having ordinary skill in the art (POSITA) would understand that there are many arrangements of these LEDs to generate desired brightness and emission angles to create intended effects which will be discussed hereafter.

In additional to providing mounting supports to and heat extraction from LEDs 105, frame 101 also provide the mechanical integrity to the overall assembly of Beam Panel 100. The shape of frame 101 can be rectangular, square, circular, oval, or any shape. The shape of frame 101 does not need to be closed patterns. For example, frame 101 can be a U-shape to provide the same mechanical strength as a rectangle as depicted in FIG. 4A. Further, fame 101 can provide mounting holes or hooks for attaching Beam Panel 100 to ceilings, wall surfaces or stands. Frame 101 can be made of, but not limited to, wood, metal, or plastic or a combination of different materials.

Figure 4B:
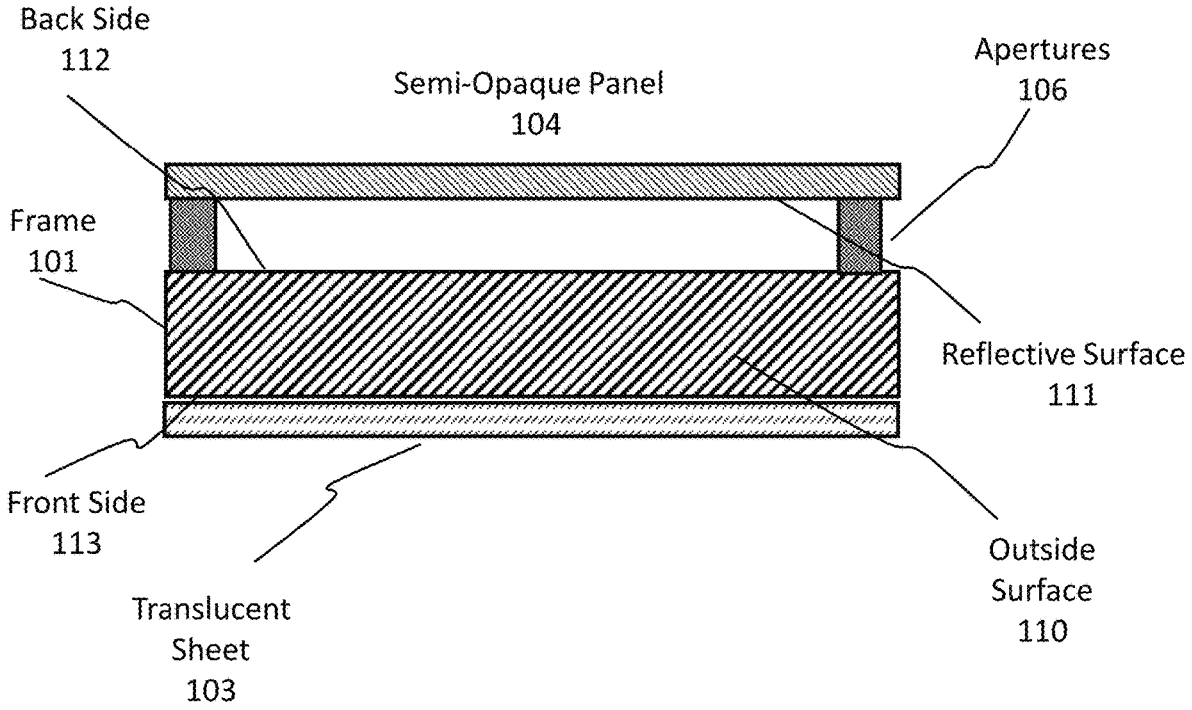

As depicted by FIG. 4A-B, attachments 102 are used to attach semi-opaque panel 104 to back side 112 of frame 101 and create apertures 106 between frame 101 and semi-opaque panel 104. Although the apertures 106 in FIG. 4A-B are shown with the same size, they can be with different sizes for different lighting effects. Light rays 107 illustrate some of the light from LEDS which escape Beam Panel 100 through apertures 106. Light rays 107 represent the directing lighting created by Beam Panel 100. The length of attachments 102 determines the amount of direct lighting of Beam Panel 100. Therefore, it is preferable that the length of attachments 102 is adjustable. The number of attachments 102 is determined by the mechanical integrity of the overall assembly. For the purpose of clarity, the diffused lighting created by Beam Panel is not shown in FIG. 4A and will be discussed in details in FIG. 6.

Semi-opaque 104 can be made of a combination of materials to create intended effects of Beam Panel 100. It is preferable that the inner surface of semi-opaque panel 104 to be highly reflective so that it directs the light from LEDs 105 to other directions without loss of much light energy. One embodiment of this present invention uses a mirror surface (i.e. aluminum or Mylar film) for semi-opaque panel 104. Such specular reflection enhances the portion of direct lighting of Beam Panel 100 as illustrated as light rays 107 in FIG. 4A. Another embodiment of this present invention uses a high reflectivity rough surface (i.e. white paint, $AlO_3$ power) for semi-opaque panel 104 to scatter the light from LEDs 105 with broad angles. Such diffused reflection enhances the portion of diffused light of Beam Panel 100. Further, another embodiment of the present invention uses a combination of specular reflective and scattering surfaces to create combined effects discussed here above. Further, color coordination of the reflective materials can be used to create attractive mixing color of light coming out from Beam Panel 100. The amount of transmission of semi-opaque panel 104 can be designed for achieving the intended effect of Beam Panel 100. In one embodiment, the transmissivity of semi-opaque panel 104 is zero when Beam Panel 100 is intended to be mounted next to a surface such as a ceiling or a wall. In another embodiment, the transmissivity of semi-opaque panel 104 is between 5% and 20% when Beam Panel is intended to be mounted with a separation to a ceiling or a wall, or on a stand. The transmitted light from semi-opaque panel 104 is preferred to be diffused lighting. In another embodiment, the transmissivity of semi-opaque panel 104 varies for different color when Beam Panel is intended to create a different color tone for different sides for artistic effects.

As illustrated in FIG. 4A-B, translucent sheet 103 is mounted directly to front side 113 of frame 101. Alternatively, translucent sheet 103 can be mounted to frame 101 with an aperture similar to the semi-opaque panel 104 via attachments. Translucent sheet 103 is intended to provide the main diffused light from Beam Panel 100. One embodiment of this present invention uses textured transparent panel (i.e. frosted glass, acrylic, polycarbonate, plastic, vinyl, etc.) for translucent sheet 103. The textured media is effective to scatter light from LEDs 105 in the forward direction. Another embodiment of this present invention uses fabrics (e.g. canvas, cloth, silk, synthetic polyester, etc.) with certain patterns and with color variations (similar to a lamp shade) for translucent sheet 103 to scatter the light both in forward and backward directions. The backward scattered light will be further reflected back by semi-opaque panel 104, further improving the uniformity of brightness of diffused lighting of Beam Panel 100. Further, another embodiment of the present invention uses a combination of diffusion and patterning to create combined effects discussed here above.

Optionally, one or more light sensors 108 are mounted to Beam Panel at various locations. Light sensors 108 can be used to perform calibrations of LEDs 105 so that certain lighting effects can be achieved after the assembly of Beam Panel or even during its installation. For example, LEDs 105 mounted on frame 101 can be electrically driven separately by a control electronics which can take the feedback signals from light sensors 108. In one embodiment, only one light sensor 108 to control the overall brightness of Beam Panel 100. In another embodiment, a plurality of light sensors 108 are used to determine the light uniformity by adjusting the currents to LEDs 105. In one embodiment, one or more of light sensors 108 is mounted to detect ambient light. In another embodiment, one or more of light sensors 108 is used as motion sensors.

The cross section of Beam Panel is depicted in FIG. 4B for clarity. Although translucent sheet 103 shown in FIG. 4A-B is mounted directly to frame 101, the translucent sheet 103 and semi-opaque panel 104 can be reversely positioned in accordance of alternative embodiments of the present invention. Reflective surface 111, as discussed above, cause the majority of the light being either reflected specularly or scattered back toward translucent sheet 103.

Figure 5A:
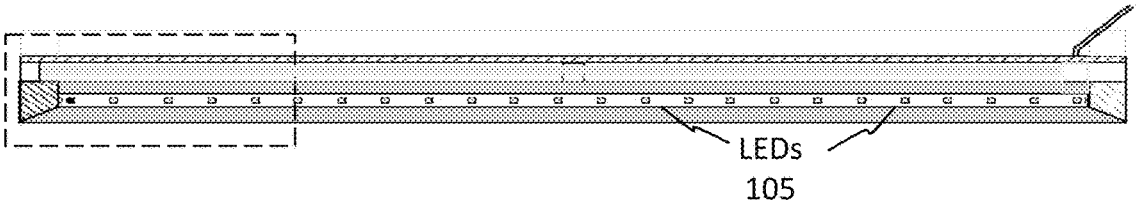
FIG. 5A-B depicts a side view of the internal arrangement of a Beam Panel according to some embodiments of the present disclosure.
Figure 5B:
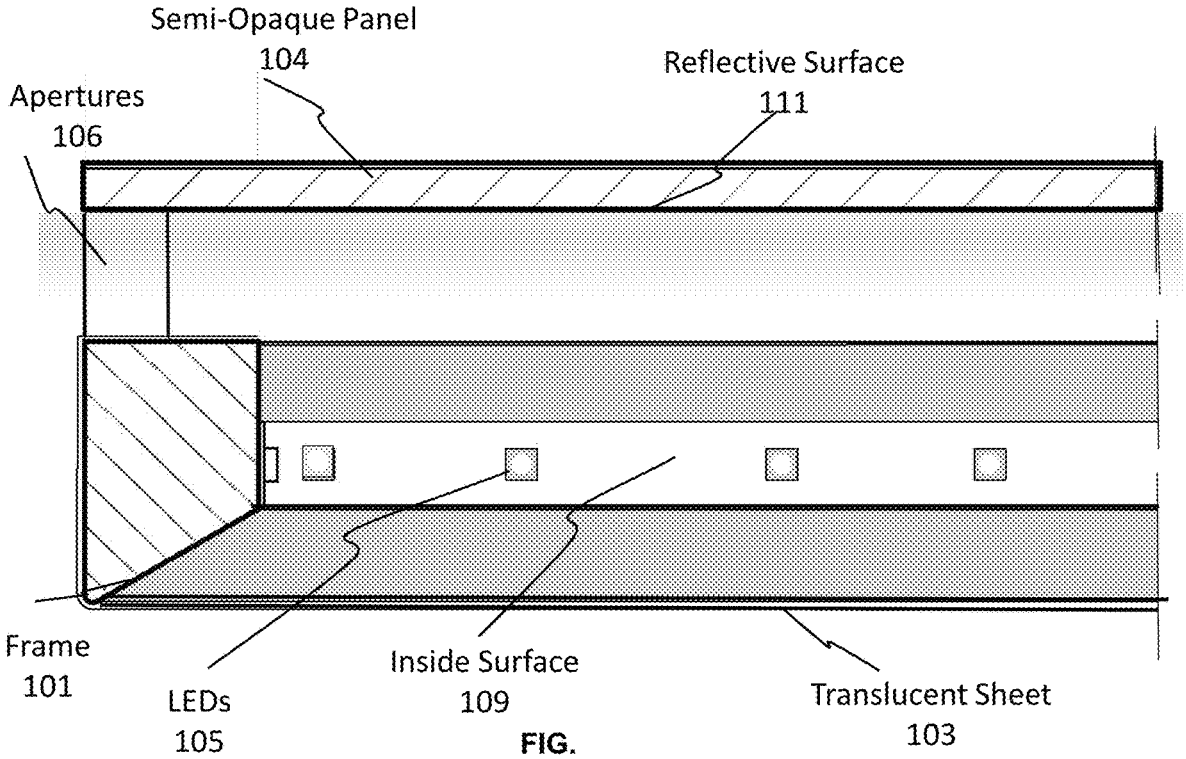

FIG. 5A depicts an internal view of Beam Panel 100 in accordance of one embodiment of the present invention. For the purpose of clarity, FIG. 5A only shows one side of frame 101 is mounted with a plurality of LEDs 105 arranged in a linear array. The use of array of LEDs creates a more uniform far-field illumination patterns when the direct light 107 coming out from Beam Panel 100 impinge upon an external object, such as wall, ceiling or even people. Combining an array of LEDs, the shadows of the attachment 102 are not as distinct or can be completely washed out. Thus, Beam Panel 100 can create 360° bright stripe outside Beam Panel 100 when all inside surfaces of frame 101 are mounted by LEDs 105. This effect will be described in later description hereafter.

LEDs from different manufacturers may have different emission patterns. For example, some LEDs have far-field patterns cover 120 degrees and some have 90 degrees. For having more light for direct lighting, LEDs with narrow far-field patterns should be used. The LEDs 105 might comprise multiple colors or similar colors. Further, the LEDs 105 can be driven electrically, all-together, in groups, completely independently, statically, or dynamically. They may even be tunable to music.

Figure 6:
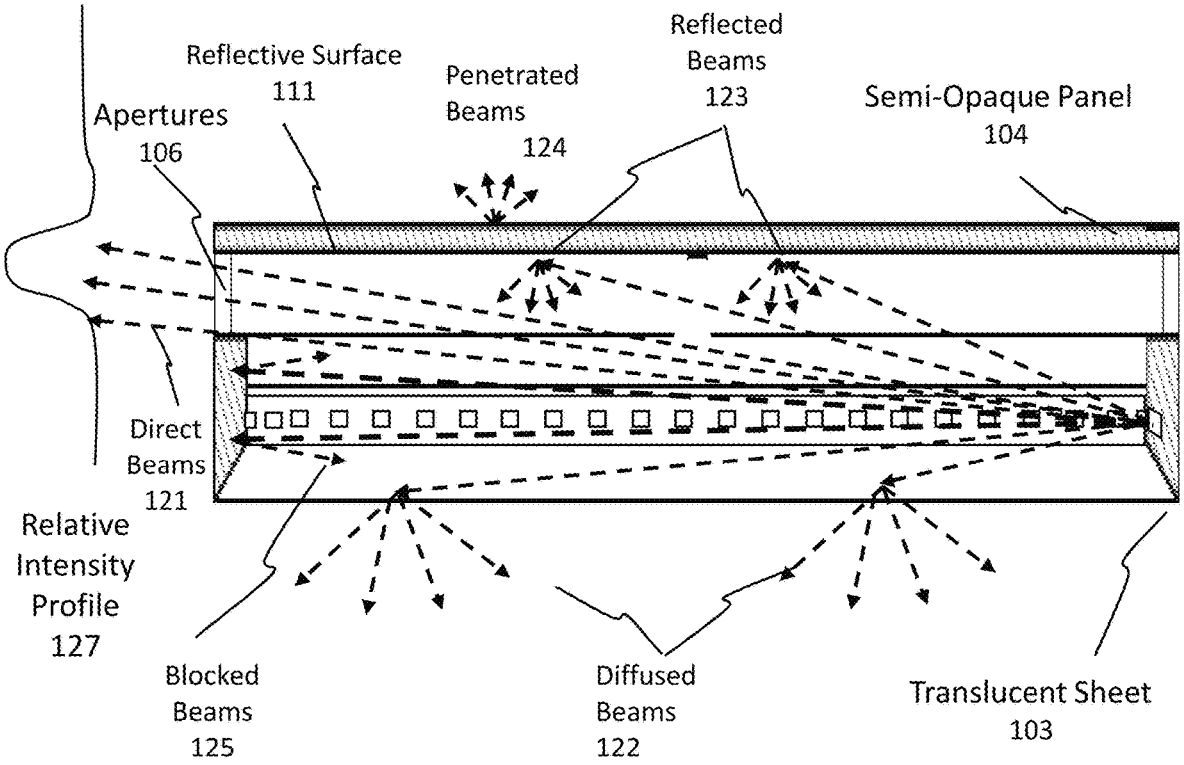
FIG. 6 illustrates the rays of light emitted from one LED inside a Beam Panel, according to some embodiments of the present disclosure.
Figure 7A:
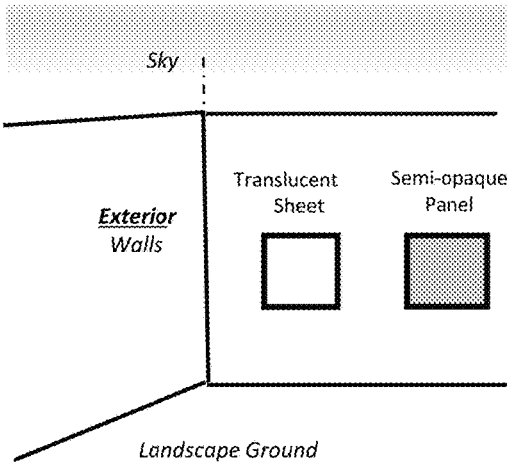
FIG. 7 illustrate how a Beam Panel can be mounted in a room for various purposes, according to some embodiments of the present disclosure.
Figure 7B:
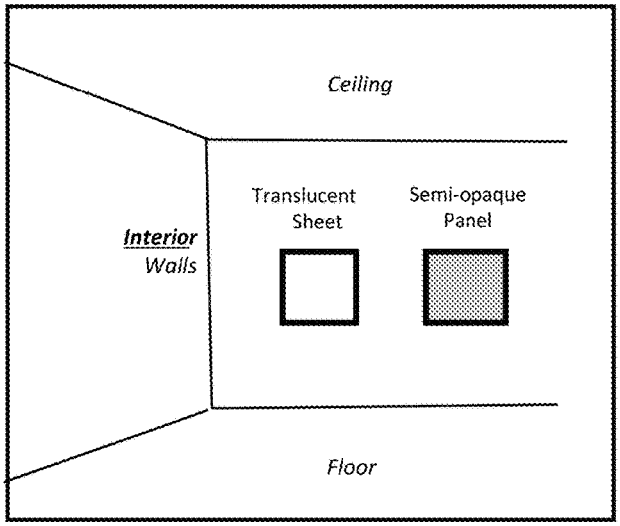
Figure 7C:
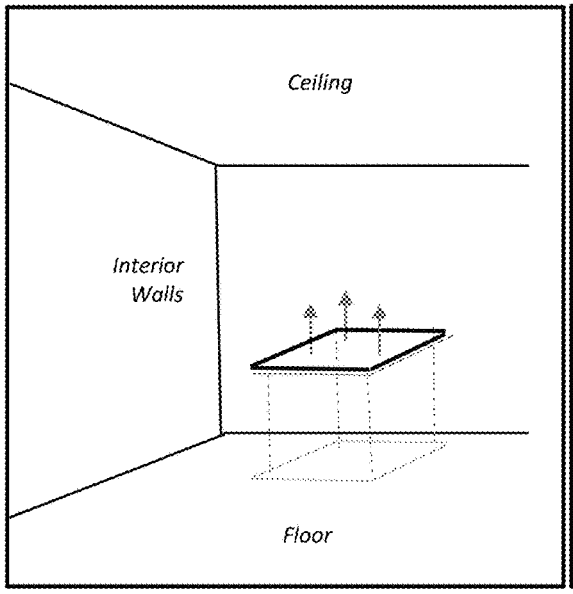
Figure 7D:
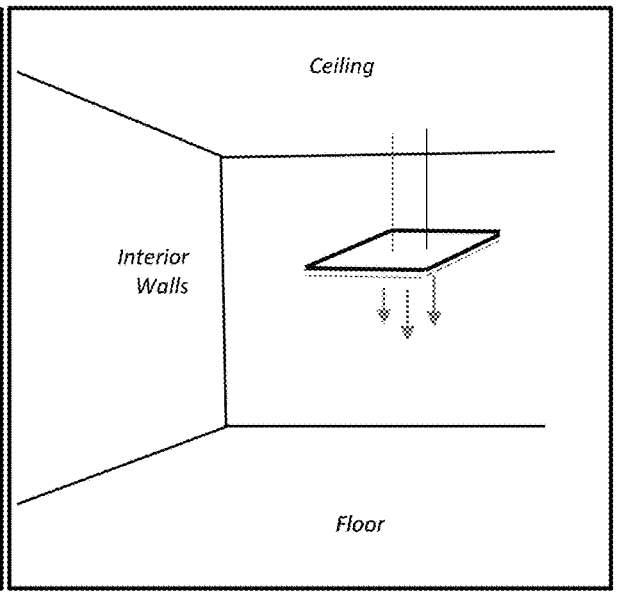

FIG. 6 depicts a side view of Beam Panel 100 and, for the purpose of clarity, only illustrates the light rays coming out from one of LEDs 105. Since the emission angle of LEDs is broad, some of the light ray impinges on semi-opaque panel 104, some impinges on translucent sheet 103, some exit from apertures 106 and some are blocked by frame 101. A POSITA would understand that, while only the light rays of one LED are illustrated in FIG. 6, the analyses of these four light paths generally apply to all LEDs 105. When the light rays from LEDs 105 shine toward aperture 106, they exit Bean Panel 100, producing direct beams 122 as the main direct lighting provided by Beam Panel 100.

When the light rays from LEDs 105 impinge on translucent sheet 103, the majority of them are scattered forward with a broad range of angle, producing diffused beams 122 as the main diffused lighting provided by Beam Panel 100. A small portion of the light rays are reflected back internally (not shown in FIG. 6 for the purpose of clarity) because of optical interface between the air and translucent sheet 103. These light rays will circulate inside Beam Panel 100 and the majority of these light rays eventually exit Beam Panel 100.

When the light rays, directly from LEDs 105 or reflected by other internal surfaces of Beam Panel 100, impinge on reflective surface 111 of semi-opaque panel 104, the majority of them are reflected backward with a broad range of angle, determined the surface structure of reflective surface 111. Some of these light rays, penetrated beams 124, may penetrate semi-opaque panel 104 and exit Beam Panel 100. Penetrated beams 124 are preferred to be diffused light. In general, the amount of light intensity of penetrate light 124 is much less than diffused beams 122 and reflected beams 123. Reflected beams 123 will circulate inside Beam Panel 100 and the majority of these light rays eventually exit Beam Panel 100.

When the light rays from LEDs 105 shine toward frame 101, they are blocked and blocked beams 125 will circulate inside Beam Panel 100 and the majority of these light rays eventually exit Beam Panel 100. To enhance the overall energy efficiency of Beam Panel 100, it is preferable to paint the internal surfaces of frame 101 white so that very little light rays coming out from LEDs 105 are absorbed by the internal surfaces of Beam Panel 100.

As explained above, with the present invention, the light rays emitted from LEDs 105 exit Beam Panel 100 into three (3) ways: direct beams 121 for direct lighting and diffused beams 122 and penetrated beams 124 for diffused lighting. Direct beams 121 exit Beam Panel 100 having a narrow range of angle, thus the shadows created by frame 101 and semi-opaque panel 104 can been seen even at a large distance. When direct beams 121 impinge on an external surface outside Beam Panel 100, they create relative intensity profile 127 as illustrated in FIG. 6. This feature gives a 3D visual effect to the beam itself, and contribute to the enhancement of some interior elements, such as existing structural members—beams, moldings, window sills, furnishings etc. Such an effect creates an appearance of architecture. Thus, Beam Panel 100 produces an architectural lighting effect. Diffused beams 122 exit Beam Panel with a broad range of angles. When diffused beam 122 impinges onto external objects, they don't create distinct shadow. Thus, Beam Panel 100 produces a diffused ambient lighting effect. On the other hand, penetrated beams 124 exit Beam Panel with a broad range of angles but with much less light intensity and possible some color tones. Thus, Beam Panel 100 produces an artistic lighting effect. These lighting effects will be illustrated in FIG. 8-11.

FIG. 7 depicts various ways to mount Beam Panel 100 indoors or outdoors. In FIG. 7A-B, Beam Panel 100 is mounted vertically. It can be mounted next to the wall or with a distance to the wall. Depending on the mounting of LEDs, the direct lighting can illuminate 180° to 360° around its edge. There are situations where the translucent sheet is facing the room for ambient lighting. There are also situation where the translucent sheet is facing the wall with a distance to emphasize a glow effect from the wall for artistic lighting. In FIG. 7C-D, Beam Panel 100 is mounted horizontally. FIG. 7C depicts a Beam Panel on a support from the floor. In this configuration, Beam Panel 100 is a tabletop supported by one or more legs. FIG. 7D depicts a Beam Panel suspended from the ceiling. In this configuration, Beam Panel 100 can be a decorative pendant light fixture.

Figure 8A:
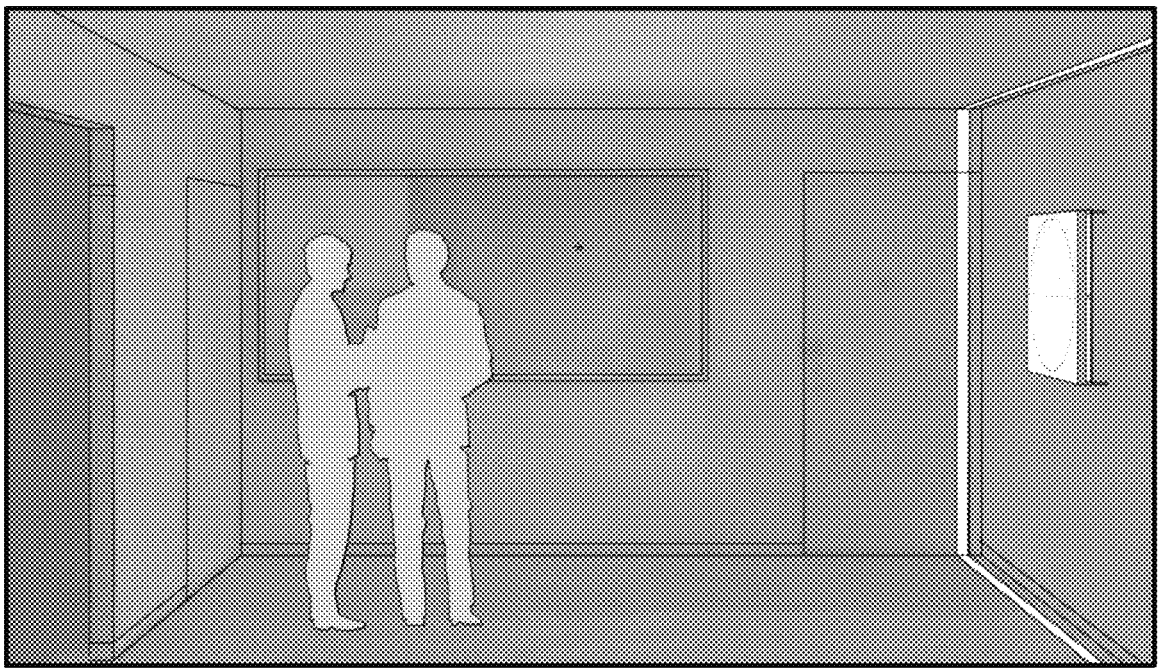
FIG. 8A-D depict various effects of a Beam Panel with different mountings, according to some embodiments of the present disclosure.
Figure 8B:
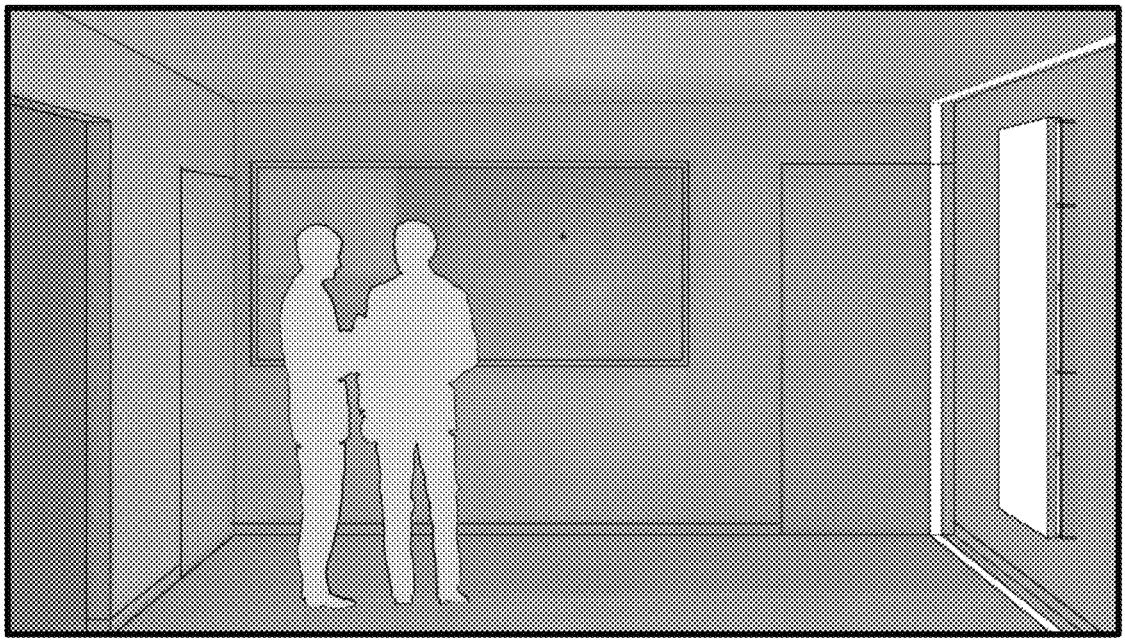
Figure 8C:
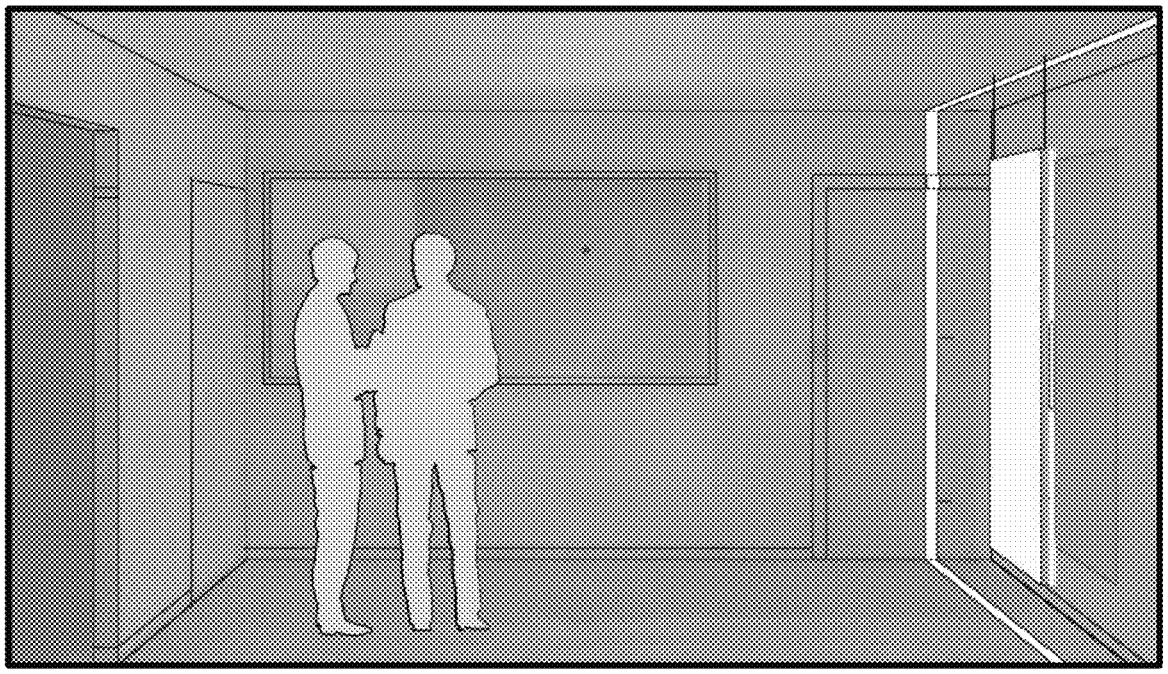
Figure 8D:
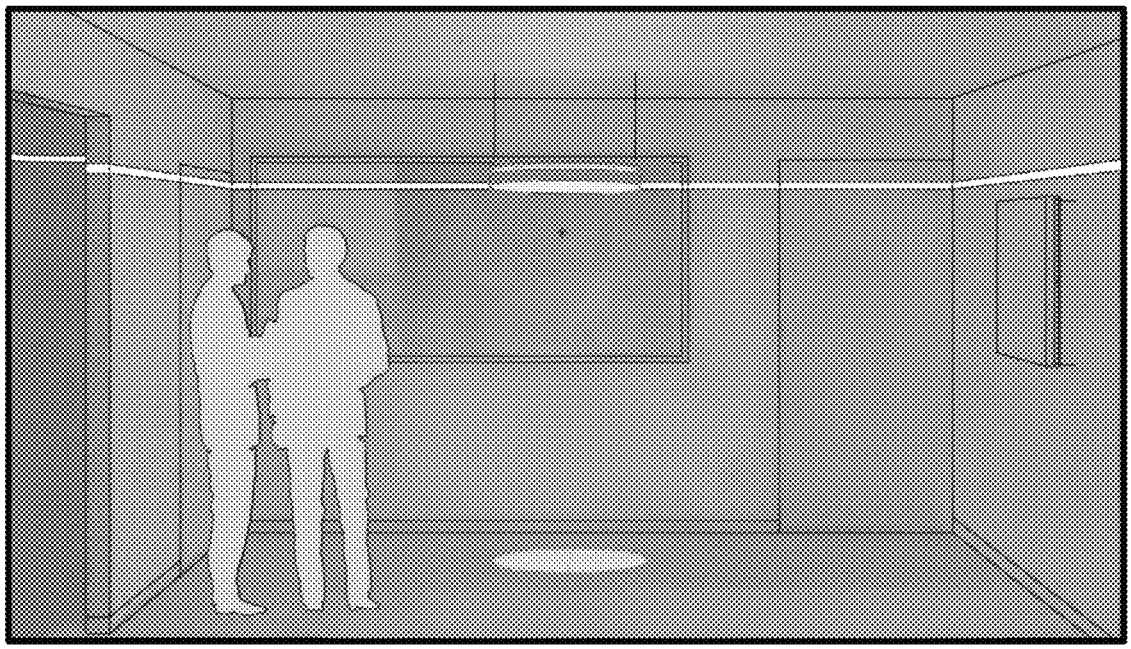

FIG. 8A-8B depict a vertical mounting configuration for Beam Panel 100 with a distance from wall. A minimum distance is preferable so that beam radiates onto ceiling, adjacent walls, and floor plane. Note that Beam Panel 100 is in a square form or a rectangular form. FIG. 8C depict a vertical mounting configuration for Beam Panel 100 suspended from the ceiling to create an appearance of a floating panel. FIG. 8D depict a horizontal mounting configuration for Beam Panel 100 suspended from the ceiling as a pendant fixture. Note that Beam Panel 100 is in a circular form.

Figure 9:
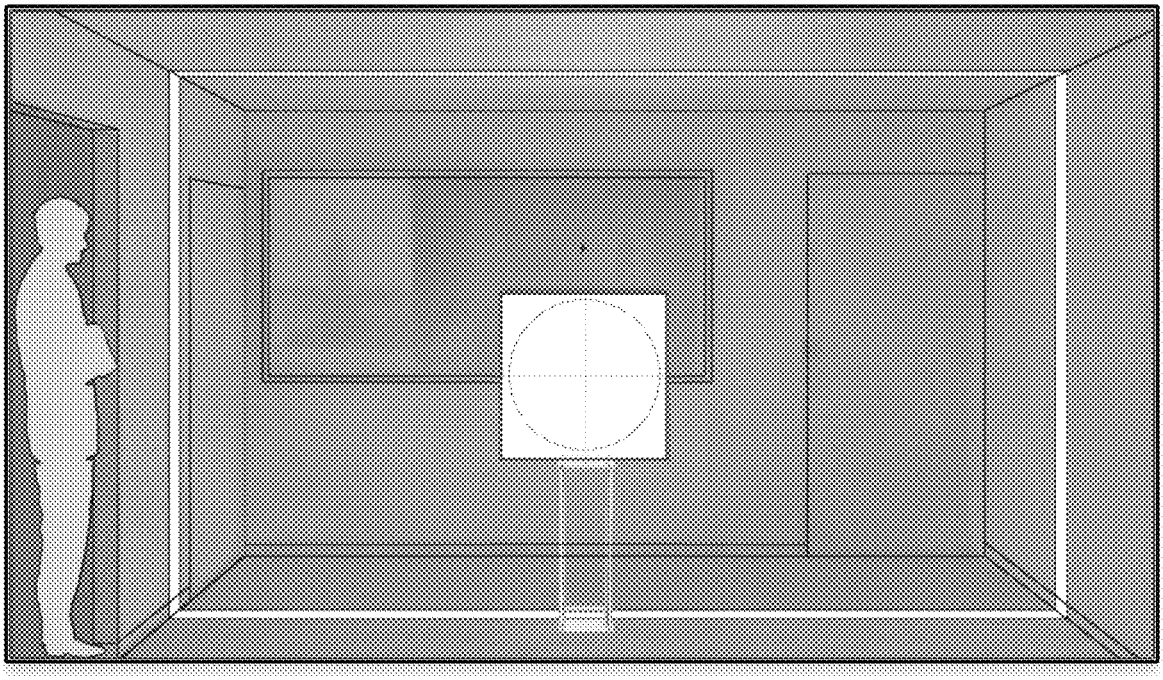
FIG. 9 depicts a Beam Panel with free-standing supports according to some embodiments of the present disclosure.
Figure 10A:
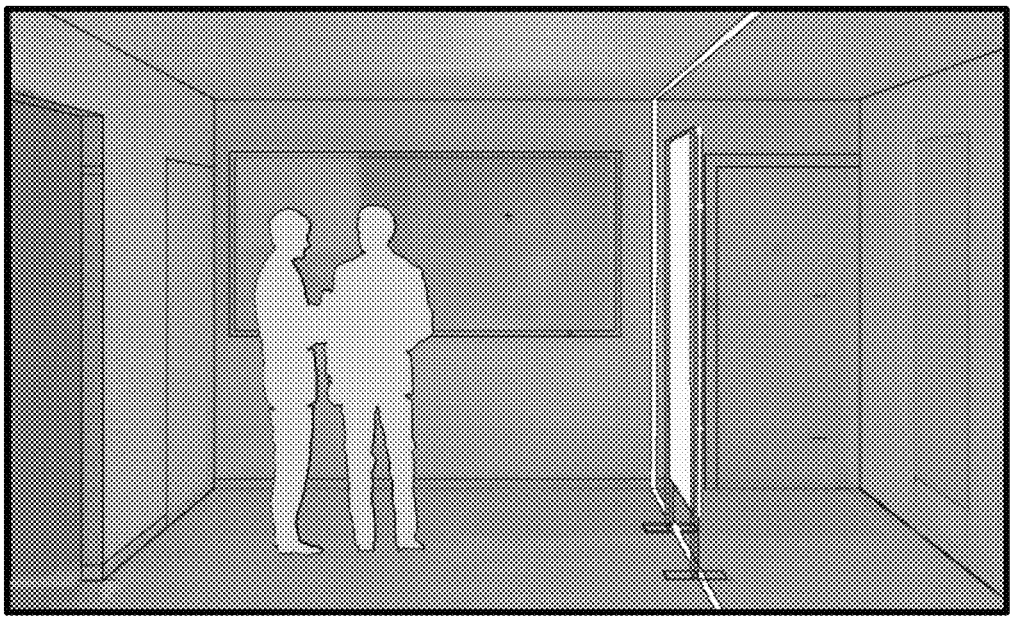
FIG. 10A-D depict various effects of Beam Panels with free standing supports, according to some embodiments of the present disclosure.
Figure 10B:
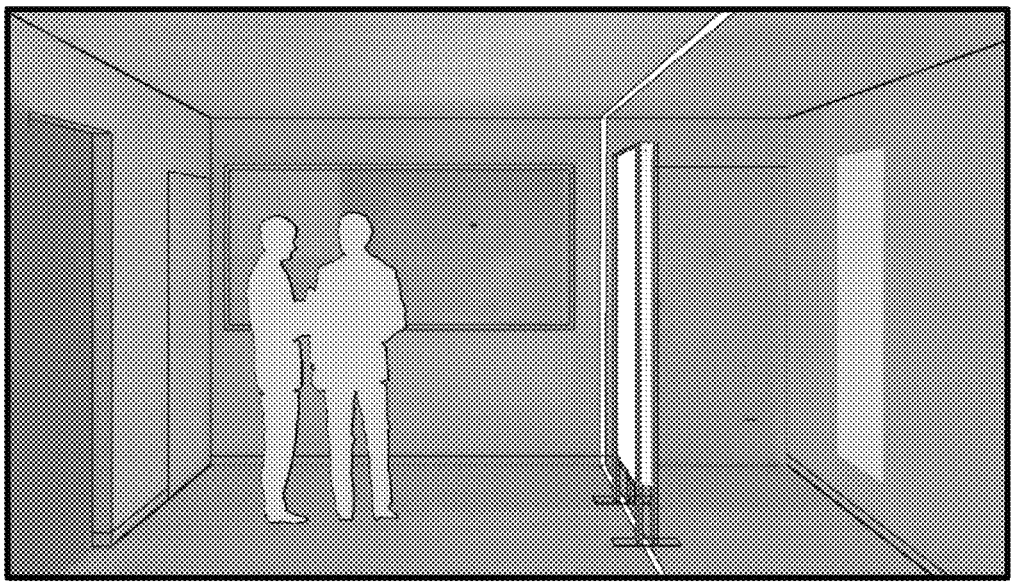
Figure 10C:
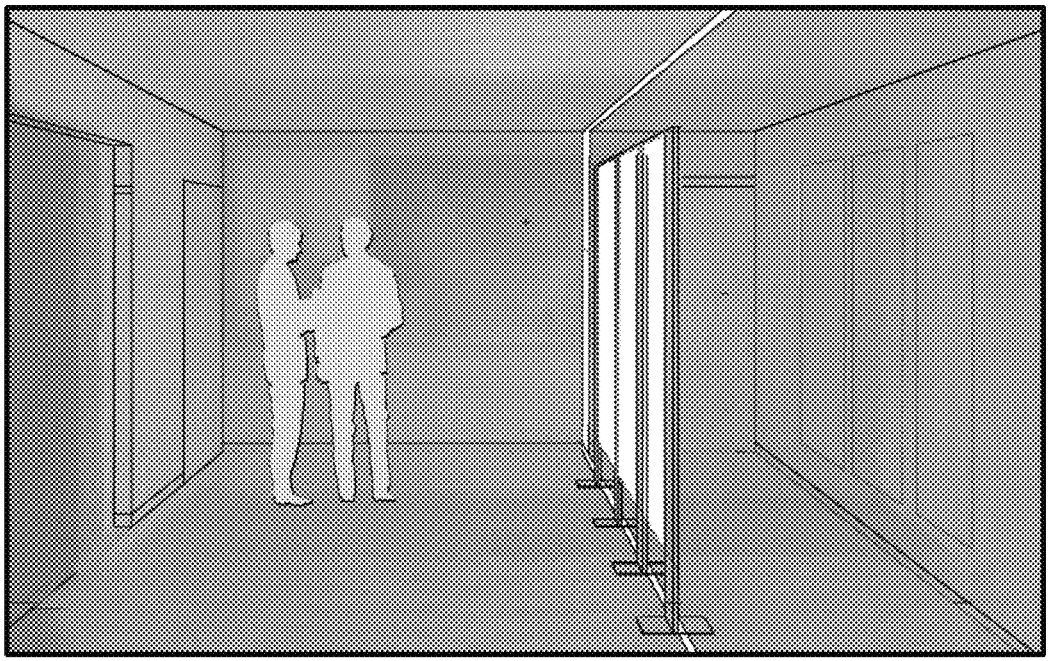
Figure 10D:
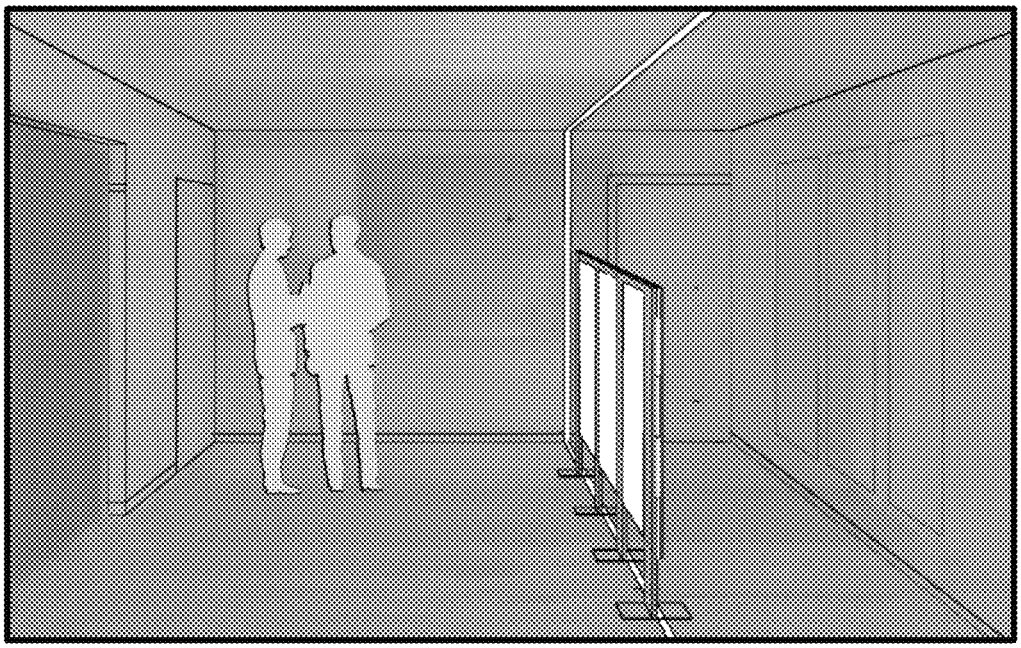

FIG. 9 shows Beam Panel 100 on a pedestal, used for display of fine art canvas at the same time used to create a virtual enclosed space with visible 360° direct light beams. The stand depicted in FIG. 9 is made of transparent material to create a sense of suspension in space. However, a POSITA would understand there are different ways to construct pedestals with various materials and shape for achieving different architectural lighting effects and visual effects of Bean Panel 100 itself.

FIG. 10A-D depict multiple Beam Panels 100 mounted on stands as free standing entrance partitions. In addition to partition and lighting, the translucent sheets can be used as backlighting for displaying information.

Figure 11:
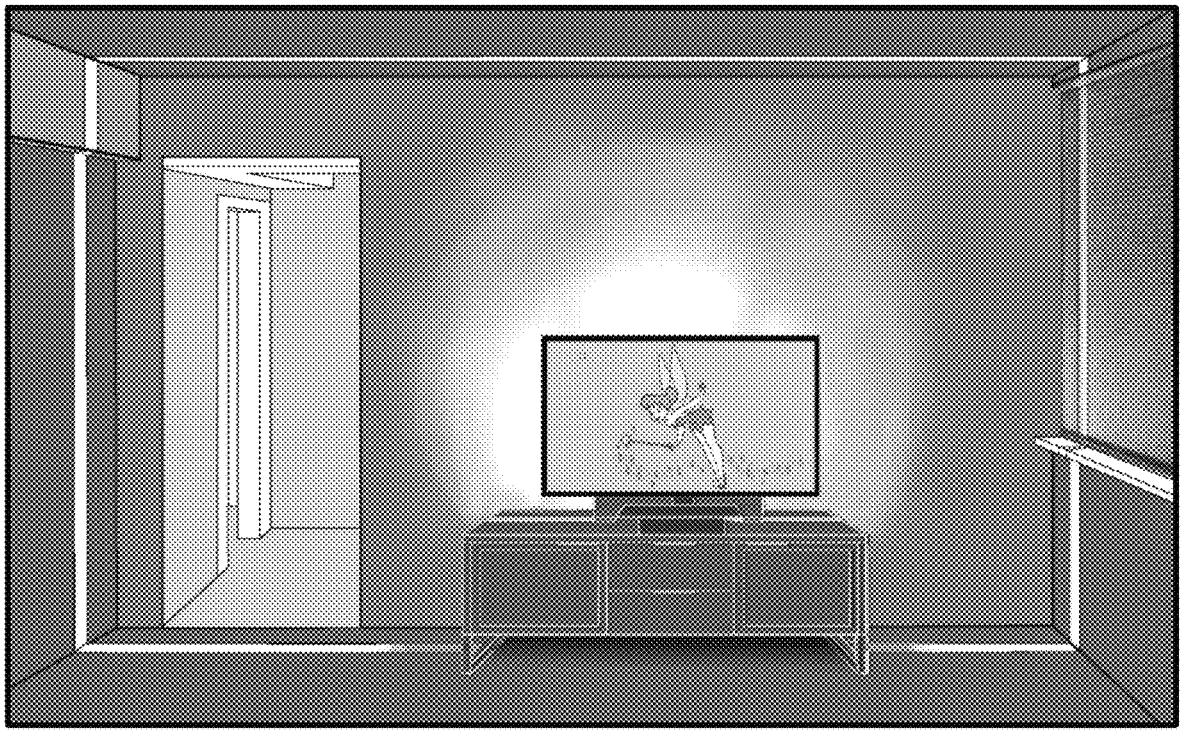
FIG. 11 depicts an effects of a Beam Panel mounted behind a TV, according to some embodiments of the present disclosure.

FIG. 11 depict Beam Panel 100 used for backlighting of TVs and monitors where the translucent sheet faces toward a wall, providing ambient color, and backlight objects in front of it. Bean Panel 100 can be placed directly on a cabinet as shown in FIG. 11 or elevated with a stand.

The preceding description sets forth numerous specific details such as examples of specific systems, components, methods, and so forth, in order to provide a thorough understanding of several examples in the present disclosure. It will be apparent to one skilled in the art, however, that at least some examples of the present disclosure may be practiced without these specific details. In other instances, well-known components or methods are not described in detail or are presented in simple block diagram form in order to avoid unnecessarily obscuring the present disclosure. Thus, the specific details set forth are merely exemplary. Particular examples may vary from these exemplary details and still be contemplated to be within the scope of the present disclosure.

Any reference throughout this specification to "one example" or "an example" means that a particular feature, structure, or characteristic described in connection with the examples are included in at least one example. Therefore, the appearances of the phrase "in one example" or "in an example" in various places throughout this specification are not necessarily all referring to the same example.

Although the operations of the methods herein are shown and described in a particular order, the order of the operations of each method may be altered so that certain operations may be performed in an inverse order or so that certain operation may be performed, at least in part, concurrently with other operations. Instructions or sub-operations of distinct operations may be performed in an intermittent or alternating manner.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Furthermore, the terms "first," "second," "third," "fourth," etc. as used herein are meant as labels to distinguish among different elements and may not necessarily have an ordinal meaning according to their numerical designation.

What is claimed is:

1. A lighting assembly comprising:

a structural frame, comprising a first side, a second side, an inside surface and an outside surface, wherein said second side opposes to said first side, said inside surface faces an enclosed space of said structure frame and said outside surface opposes to said inside surface;

a plurality of light-emitting diodes (LEDs) mounted on said inside surface of said structural frame, said plurality of LEDs emitting a plurality of light rays (LED Light Rays);

a first panel coupled onto said first side of said structural frame, said first panel diffusing light; and a second panel coupled onto said second side of said structural frame with an open space between said second panel and said structural frame, said second panel diffusing light;

wherein said open space allows exit of a first portion of said LED Light Rays, said first panel allows exit of a second portion of said LED Light Rays, and said second panel allows exit of a third portion of said LED Light Rays;

wherein said first portion of said LED Light Rays are characterized as direct lighting and said second and said third portions of said LED Light Rays are characterized as diffused lighting;

wherein said third portion of said LED Light Rays has an overall light amount less than said second portion of said LED Light Rays.

2. The lighting assembly of claim 1 further comprising one or more light sensors.

3. The lighting assembly of claim 1, wherein said first portion of said LED Light Rays has an overall light amount less than said second portion of said LED Light Rays.

4. The lighting assembly of claim 1, wherein said third portion of said LED Light Rays has an overall light amount less than 5% of said second portion of said LED Light Rays.

5. The lighting assembly of claim 1, wherein said third portion of said LED Light Rays has an overall light amount between 5% and 20% of said second portion of said LED Light Rays.

6. The lighting assembly of claim 1, wherein said first portion of said LED Light Rays has an overall light amount between 5% and 20% of said second portion of said LED Light Rays.

7. The lighting assembly of claim 1, wherein said LEDs emit multiple colors.

8. The lighting assembly of claim 2, wherein said LEDs are individually controlled by an electronic circuit wherein said light sensors are coupled to said electronics circuit.

9. The lighting assembly of claim 1, wherein said first and second panels have a rectangular shape defined by a width and a length, and wherein said structural frame supports said panels along peripheries of said panels, having a depth smaller than said width and said length.

10. The lighting assembly of claim 1, wherein said first and second panels have a round shape defined by a minimum width, and wherein said structural frame supports said panels along peripheries of said panels, having a depth smaller than said minimum width.

11. The lighting assembly of claim 1, further comprising a transparent material to cover a portion of said open space.

12. The lighting assembly of claim 1, wherein a size of said open space is adjustable.

13. The lighting assembly of claim 1, further comprising a mounting means, said mounting means configured to support said lighting assembly.

14. The lighting assembly of claim 12, where said mounting means suspends said lighting assembly from a ceiling.

15. The lighting assembly of claim 12, where said mounting means attaches said lighting assembly to a wall.

16. The lighting assembly of claim 12, where said mounting means support said lighting assembly from a floor surface.

17. A lighting assembly comprising:

a structural frame, comprising a first side, a second side, an inside surface and an outside surface, wherein said second side opposes to said first side, said inside surface faces an enclosed space of said structure frame and said outside surface opposes to said inside surface;

a plurality of light-emitting diodes (LEDs) mounted on said inside surface of said structural frame, said plurality of LEDs emitting a plurality of light rays (LED Light Rays);

a first panel coupled onto said first side of said structural frame, said first panel diffusing light; and a second panel coupled onto said second side of said structural frame with an open space between said second panel and said structural frame, said second panel diffusing light;

wherein said open space allows exit of a first portion of said LED Light Rays, said first panel allows exit of a second portion of said LED Light Rays, and said second panel allows exit of a third portion of said LED Light Rays;

wherein said first portion of said LED Light Rays are characterized as direct lighting and said second and said third portions of said LED Light Rays are characterized as diffused lighting;

wherein said third portion of said LED Light Rays has an overall light amount more than said second portion of said LED Light Rays.

18. The lighting assembly of claim 17, wherein said second portion of said LED Light Rays has an overall light amount less than 5% of said third portion of said LED Light Rays.

19. The lighting assembly of claim 17, wherein said second portion of said LED Light Rays has an overall light amount between 5% and 20% of said third portion of said LED Light Rays.

20. The lighting assembly of claim 17 further comprising one or more light sensors.

* * * * *